US007287607B1

(12) United States Patent
Falgout, Sr.

(10) Patent No.: US 7,287,607 B1
(45) Date of Patent: Oct. 30, 2007

(54) DIRECTIONAL DRILLING APPARATUS

(76) Inventor: Thomas E. Falgout, Sr., 110 Charles Read St., Lafayette, LA (US) 70503

( * ) Notice: Subject to any disclaimer, the term of this patent is extended or adjusted under 35 U.S.C. 154(b) by 0 days.

(21) Appl. No.: 11/514,539

(22) Filed: Aug. 4, 2006

(51) Int. Cl.
*E21B 7/04* (2006.01)
*E21B 4/02* (2006.01)

(52) U.S. Cl. ..... 175/61; 175/74; 175/107; 166/237

(58) Field of Classification Search ..... 175/61, 175/62, 73, 74, 92, 101, 107, 320; 464/18, 464/19; 166/237
See application file for complete search history.

(56) References Cited

U.S. PATENT DOCUMENTS 3,586,116 A * 6/1971 Tiraspolsky et al. ..... 175/74
5,048,621 A * 9/1991 Bailey et al. ..... 175/74
5,232,058 A * 8/1993 Morin et al. ..... 175/73
5,495,900 A 3/1996 Falgout, Sr.
6,571,888 B2 * 6/2003 Comeau et al. ..... 175/61
6,955,231 B1 * 10/2005 Bakke ..... 175/61

* cited by examiner

*Primary Examiner*—Kenneth Thompson
(74) *Attorney, Agent, or Firm*—John D. Jeter

(57) ABSTRACT

A drilling motor is housed in the upper portion of a housing, with a drive shaft extending through a lower portion of the housing. The two portions are coupled by bearing that has an axis of rotation that is tilted a small amount relative to the axes of both portions. The lower portion is rotationally coupled to the lower housing until a small amount of drilling fluid flow, or a preselected amount of motor torque, forces a clutch to disengage the motor, rotationally, from the lower housing. The lower portion is allowed limited rotation relative to the upper portion. At one rotational limit, the housing is in the straight configuration. At the other limit, the housing is in the deflected configuration. Conversion to the straight configuration is achieved, while drilling fluid flows, when the drill string is rotated, by formation drag, which rotates the lower portion to the straight configuration.

17 Claims, 5 Drawing Sheets

DIRECTIONAL DRILLING APPARATUS

This invention pertains to well drilling and to the control of the direction of well bores while being drilled.

BACKGROUND OF THE INVENTION

Directional drilling is now commonly practiced in petroleum related drilling activity. The control of the course of the progressing well bore has historically been an expensive and time consuming activity. Extensive effort has been made to provide apparatus for use in the bottom hole assembly of the drill string that can be activated to change the course of the progressing well bore, then convert back to optimum drilling arrangements. That objective has experienced very limited success.

In many earth formations, it is convenient and economical to drill with down hole drilling motors. In many of those cases it is necessary to exercise control of the course of the progressing well bore while drilling. The need for directional control is usually brief. Once correction is made in the well bore course, optimum drilling conditions can usually be restored for an extended period of time.

The drilling motor usually has a flexible drive shaft between the motor and the output shaft that drives the drill bit. Further, the output shaft that drives the drill bit is supported on a rugged bearing arrangement with a rotational axis that coincides with the well bore center line. When bent motor housings are used to deflect a well bore while drilling, the bend is usually between the motor and the bearing assembly supporting the motor output shaft. Usually, the flexing ability of the flexible drive shaft can accommodate the bend without modification. The bent body is often used with a non-rotating drill string for deflecting the well bore, then, it is rotated to produce a straight hole. The stresses produced by rotating a bent body can often be accommodated by the bottom hole assembly for a short time. As a long term matter, there is reduced confidence in the reliability of the bottom hole assembly.

There are deflecting apparatus for selectively bending the motor housing for directional work, then straightening the housing for straight hole drilling. Activation of such equipment usually involves communication from the surface. There is usually some uncertainty about the apparatus receiving and responding to such communication. The return to straight drilling mode may be attended by the same uncertainty.

The common drilling motor is powered by drilling fluid and starts at the onset of flow of drilling fluid. It can stall briefly without consequent damage. While it is stalled, some fluid leaks through. The drilling motor is capable of considerable torque. If the stall factor is suddenly released, the pressure drop through the motor may change well over two hundred psi. These factors make the drilling motor an ideal power source for activating drill string deflecting apparatus.

SUMMARY OF THE INVENTION

The apparatus is situated in a housing of upper and lower portions that can be bent between the two portions. The portions are connected by a deflection actuator bearing pack that permits the lower portion to rotate a limited amount relative to the upper portion. The deflection actuator bearing assembly has an axis of rotation that is tilted and, preferably, crosses the center line of the upper portion. When the lower portion is rotated, relative to the upper portion it's center line tends to describe a cone. The rotation is limited and the lower portion only rotates a partial turn to achieve the desired deflection of it's center line from a line containing the center line of the upper portion. Before deflection of the lower portion, it's center line is aligned with the center line of the upper portion.

A drilling fluid powered motor, preferably a drilling motor, is situated in the upper portion' with a drive shaft extending, at least, into the lower portion.

The lower portion is rotation limited such that normal rotation of the drill string, and formation drag on the lower portion places the two portions in a straight configuration. To deflect the lower portion, it is rotated clock wise, viewed from above, relative to the upper portion.

To rotate the lower portion clockwise, the motor is briefly connected to the lower portion. That occurs shortly after the flow of drilling fluid is stopped. When drilling fluid flow is started, the motor starts, and rotates the lower portion to the deflected limit stop. The motor then stalls. The stand pipe pressure suddenly increases.

A time delay clutch controls the connection between the motor and the lower portion. The clutch engages when there is no drilling fluid flow, and disengages when a preselected amount of fluid passes through the motor. A drilling motor normally has enough leakage to suitably actuate the clutch for release of the lower portion. Optionally, a leak path can be provided to by-pass the motor. When the clutch releases the motor from the lower portion, the standpipe pressure suddenly drops. The pressure drop can serve as a signal, detectable at the standpipe, that the motor has rotated the lower portion, has been freed from the lower portion, and is now free to proceed with deflected drilling.

When the deflected configuration is used, the drill string is not rotated. The drilling motor rotates clockwise, viewed from above, and the drag of the output shaft bearings and seals tend to maintain the deflected configuration.

When it is intended to do straight hole drilling, and drilling fluid flow is started, the deflection actuation just described is accepted in the interest of simplicity. When the motor is released from the lower portion, the drill string is engaged for rotation and drilling proceeds. The lower portion, having been first deflected, will be rotated counter clockwise, by formation drag, to the straight configuration. As long as drilling fluid flows, the clutch will not connect the motor to the lower portion.

The clutch is a sleeve piston spline-connected to the lower portion, with lugs to rotationally engage slots on the motor drive shaft when it is allowed to move against the drilling fluid flow. The sleeve piston is spring loaded into engagement and driven toward disengagement by fluid pressure in the drill string. The clutch is, preferably, arranged to be torque limited. It will release at a preselected torque. When the motor is rotationally released by the clutch, the motor will turn freely and allow a surge of drilling fluid to move the sleeve piston to avoid clash of clutch lugs and slots. Delay of movement of the sleeve piston is achieved by limiting the rate of movement of the sleeve piston, by metering fluid movement below the piston.

These and other objects, advantages, and features of this invention will be apparent to those skilled in the art from a consideration of this specification, including the attached claims and appended drawings

DETAILED DESCRIPTION OF DRAWINGS

In the formal drawings, some features that do not bear upon points of novelty and are commonly known to those skilled in the art of machine construction are omitted in the interest of descriptive clarity. Such omissions may include weld lines, threaded connections, threaded fasteners, pins, plugs, and the like.

Figure 2:
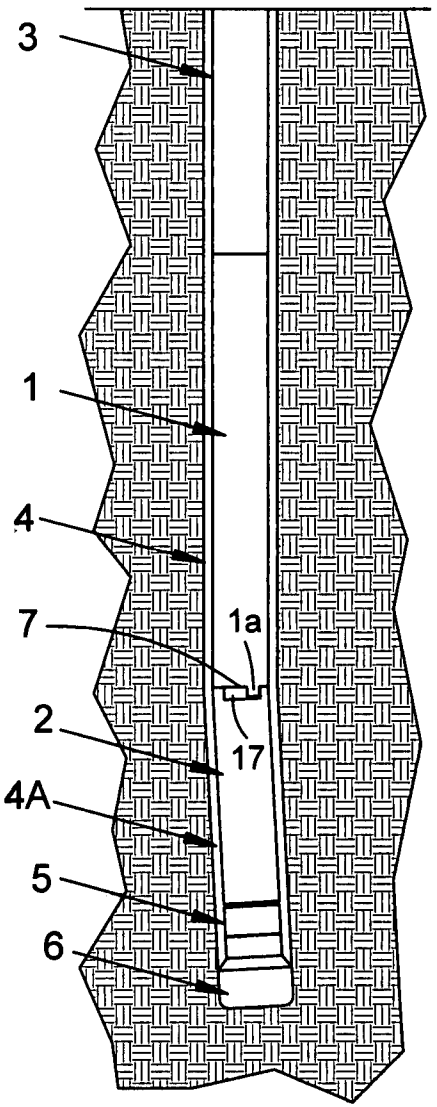
FIG. 2 is the same as FIG. 1, but the apparatus is in the deflected configuration.
Figure 1:
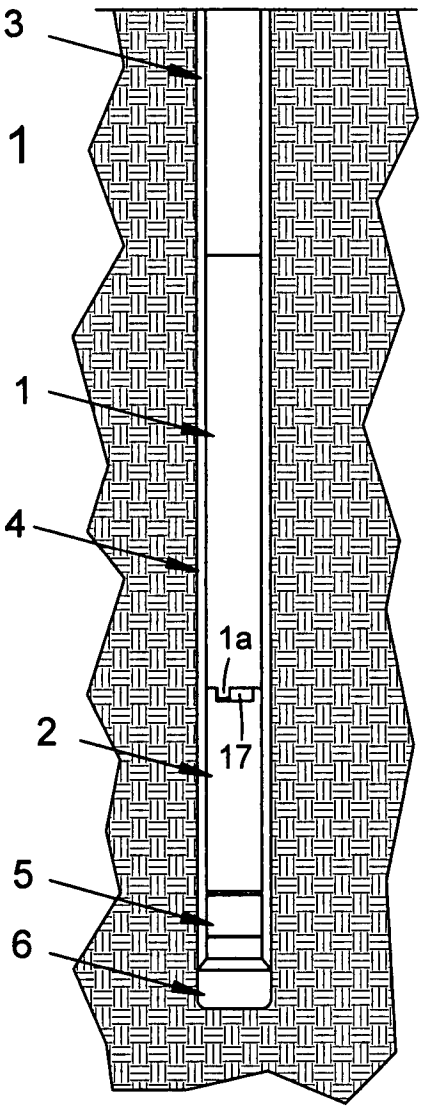
FIG. 1 shows a well bore with the apparatus of the invention situated therein.

FIGS. 1 and 2 show the apparatus comprising housing upper portion 1 and lower portion 2 in well bore 4. The upwardly continuing drill string 3 and the downwardly continuing drill string (drill bit 6) are in the straight configuration. A drilling fluid powered motor, preferably a drilling motor is housed in portion 1 with a drive shaft (not shown) extending through lower portion 2. Lower portion 2 contains a bearing pack (not shown) for the output shaft 5. Deflection controls are shown as slot 17 on the lower portion 2 which limits movement of lug 1*a* on the upper portion 1.

FIG. 2 shows the drill string bent at point 7 and proceeding to drill a deflected well bore 4A along the center line of lower portion 2.

Figure 4:
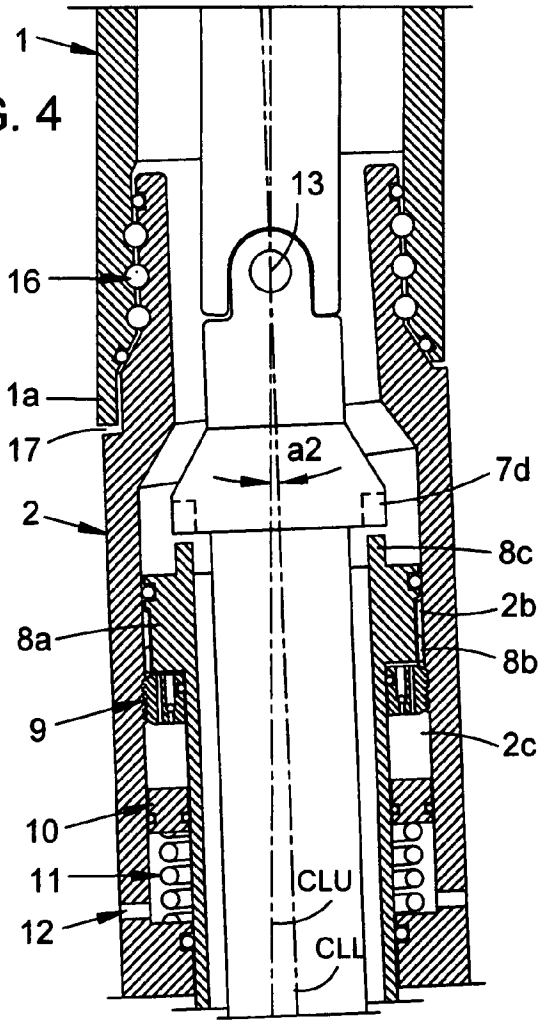
FIG. 4 is identical to FIG. 3, but the clutch is disengaged.
Figure 3:
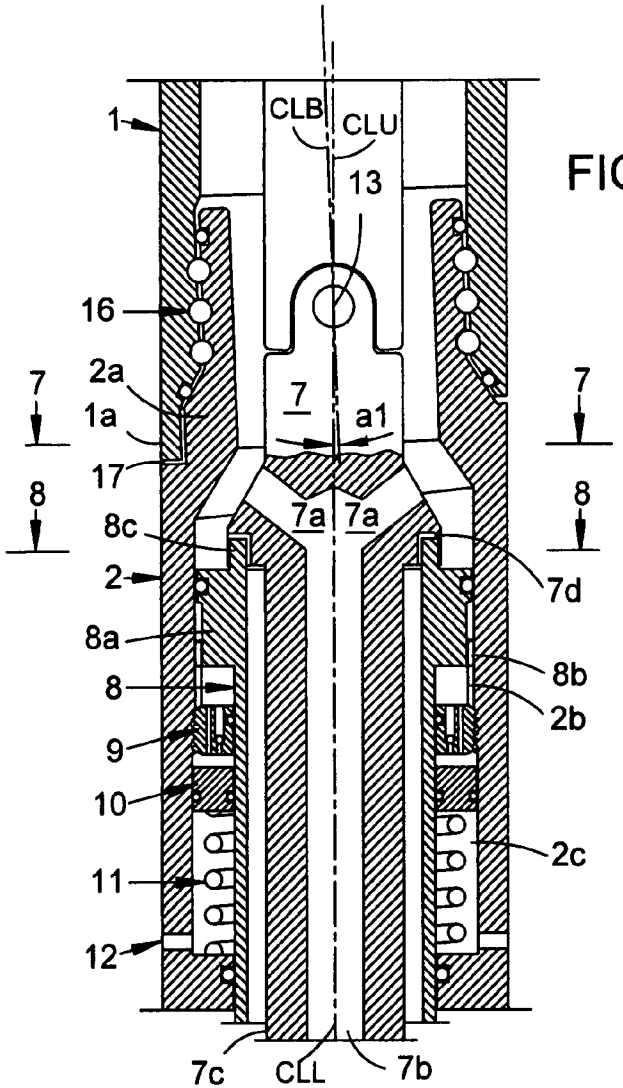
FIG. 3 is a side view, mostly cut away, and rather enlarged, of that portion of the apparatus containing the deflection actuation, deflection control, and clutch assemblies.

FIGS. 3 and 4 show the lower end of upper portion 1 connected by deflection bearing pack 16 to the upper end 2*a* of the lower portion 2. A motor drive shaft 7, flexing at point 13, extends through the deflection drive assembly and the clutch, which includes lugs 8*c* and slots 7*d*. The deflection drive assembly includes sleeve piston 8 with lugs 8*c* to engage the drive shaft slots 7*d* and splines 8*b* to engage splines 2*b* on the lower portion. As shown by FIG. 3, the drive shaft is rotationally connected to the lower portion 2. The deflection drive action rotates the lower portion about tilted axis CLB, which deflects the center line of the lower portion CLL relative to the center line CLU of the upper portion. Center line CLB is the center line of the deflection bearing pack.

The clutch includes sleeve piston 8, slidable in annular chamber 2*c*, urged downward by pressure inside the housing vented to the well annulus through port 12. The downward movement, in time, will remove the lugs 8*c* from slots 7*d* (see FIG. 4) and allow the motor to rotate the drive shaft and, finally, the output shaft 5 and connected drill bit 6. Time delay of the clutch results from metering fluid through regulator ring 9 (secured to the lower portion, see FIG. 9) to drive the separator ring 10 downward. To insure timely release of the clutch, the engaging abutments are sloped so that torque transmitted urges the clutch toward disengagement (see FIG. 14). If the clutch is released by torque, the freed motor surges and the flow of mud moves the piston 8*a* downward and prevents clashing of the clutch lugs and slots. Mud exists below the separator ring, and oil fills the annulus between ring 10 and piston head 8*a*. The clutch and the deflection drive apparatus utilizes some of the same parts.

Annular piston 8*a*, situated in housing 2, to respond to drilling fluid pressure in the housing to produce axial movement, for clutch actuation, comprises a hydraulic cylinder which qualifies as a linear motor. The linear motor, in it's various forms, is well known to those skilled in the art of machine construction.

The clutch will stay open while pressure inside the housing exceeds, by a preselected amount, the pressure outside the housing. When drilling fluid flow is stopped, spring 11 urges ring 10 upward and fluid flows through a check valve (9*a* in FIG. 5) in ring 9 to move piston head 8*a* upward to re-engage the clutch.

Deflection control is achieved by lug 1*a* and control slot 17. The slot and lug is so arranged that if the drill string is rotating and formation drag on the lower portion retards it's rotation, it will be stopped relative to the upper portion, when it is in the straight configuration. The allowed motor driven rotation of the lower portion, in conjunction with the angular tilt of axis CLB, will cause the preselected amount of deflection of the center line of the lower portion relative to the upper portion. The upper portion is attached to the drill string and may be assumed to lie along the established well bore direction.

Shaft extension 7*c* is rigidly connected to the output shaft 5 and fluid channels 7*a* and 7*b* are optional. Their use depends somewhat upon the apparatus size and planned fluid flow rates. Line CLU is the extended center line of the upper portion and is also the center line of the lower portion when the apparatus is in the straight drilling configuration. Angle a1 is the tilt of the bearing pack 16. Angle a2 is the deflection of the lower portion relative to the upper portion.

Figure 7:
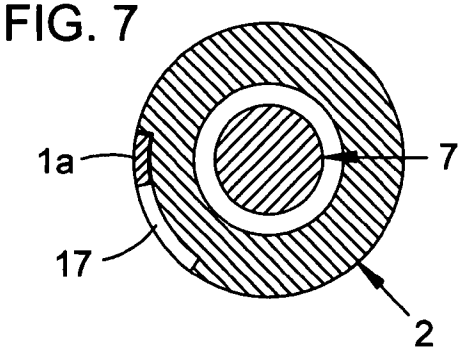
FIG. 7 is a section taken along line 7 of FIG. 3.
Figure 6:
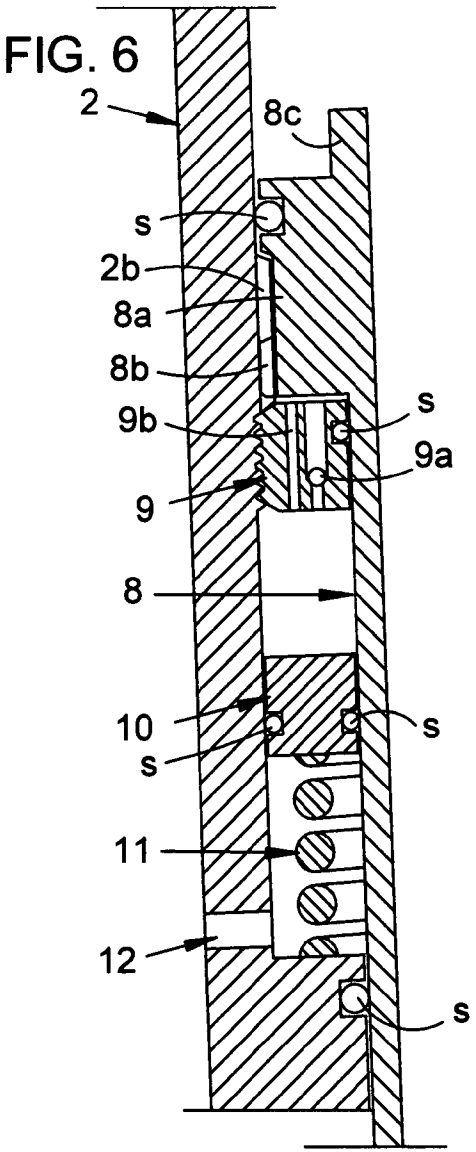
FIG. 6 is the same as FIG. 5, but applies to FIG. 4.
Figure 5:
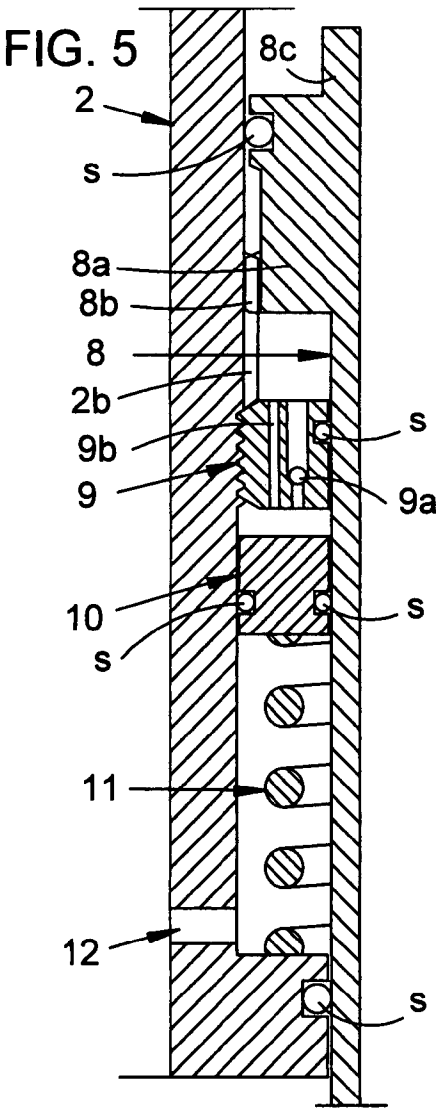
FIG. 5 is a fragmented sectional view of the left wall of the apparatus of FIG. 3, rather enlarged, to show some details not of clear scale on FIG. 3.

FIGS. 5 and 6 are enlarged sections of only a left wall of FIGS. 3 and 4 respectively. Seals s are shown as s, and splines 8*b* and 2*b* are more visible. Other details are already described or will be described by FIG. 9. Metering channel 9*b* and check valve 9*a* are now visible FIG. 7 is a section taken along line 7 of FIG. 3. Viewed from the top, lower portion 2 has been dragged counter clockwise to the travel limit of lug 1*a* in slot 17. This is the straight configuration. When the motor is used to turn portion 2 clockwise as far as lug 1*a* permits, it will be in the deflected configuration.

Figure 8:
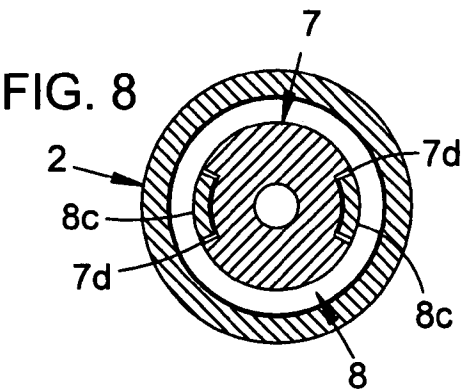
FIG. 8 is a section taken along line 8 of FIG. 3.

FIG. 8 shows the relationship of lugs 8*c* and slots 7*d*. The top of sleeve piston 8 is the area acted upon by the pressure inside the housing, the lower piston area being vented to the well annulus through port 12.

The pressure inside the housing is induced by drilling fluid flow and piston 8*a* comprises part of a fluid powered cylinder, vented through port 12 to the exterior of the housing, resulting in a drilling fluid powered linear motor as understood by those skilled in the art of machine construction.

Figure 9:
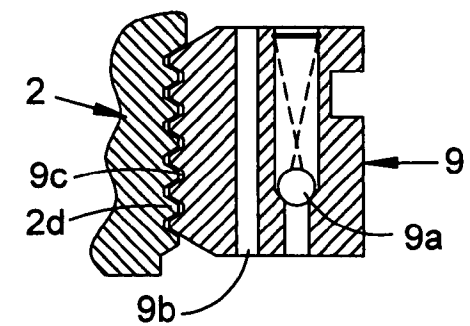
FIG. 9 is a section, rather enlarged, cut through the annular ring 9.

FIG. 9 is a rather enlarged section through the side of regulator ring 9. The fragment of the lower portion 2 shows the threads 2*d* which engage the threads 9*c* on the ring. Check valve 9*a* allows the clutch to rapidly engage the motor to the lower portion once drilling fluid flow ceases. Oil is metered through restriction 9*b* to delay the clutch release of the motor from the lower portion. Restriction 9*b* is shown as an single channel but, instead, may be one of several installable restrictors.

Figure 10:
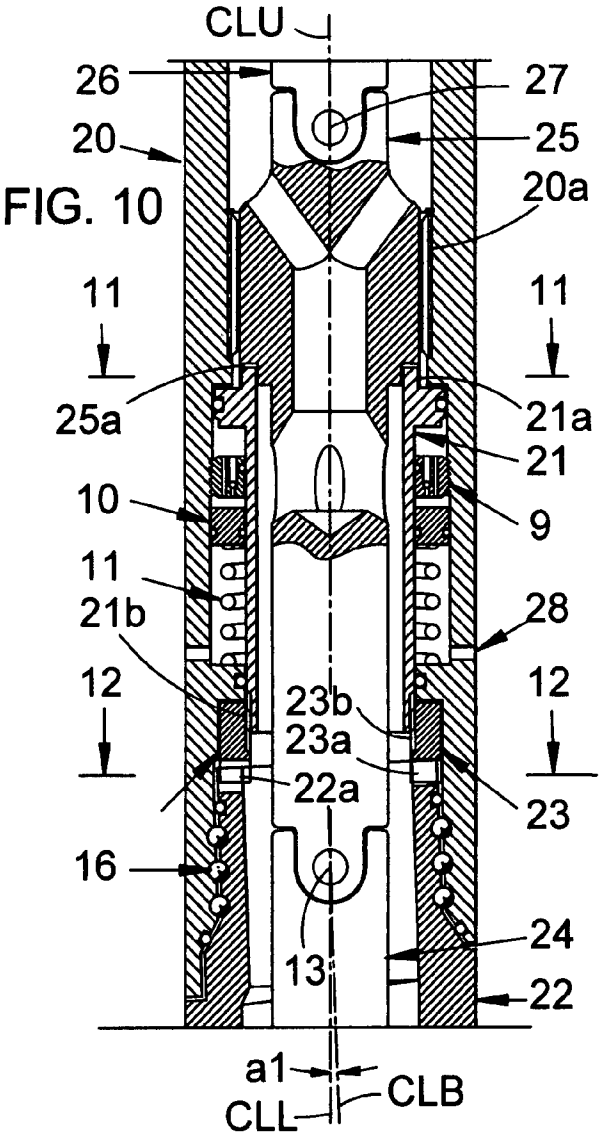
FIG. 10 is a view functionally similar to FIG. 3 but the principal machinery involved is placed above the point of drill string deflection.

FIG. 10 is essentially the same apparatus as FIG. 3 but many functional parts are moved into the upper portion 20 in order to place the deflection point 13 closer to the drill bit. This arrangement, if used with the usual positive displacement mud driven motor, usually requires a flexible connection 27. Bearing 20*a* is used to stabilize the additional shaft element 25. The deflection drive now includes lugs 21*a* on sleeve piston 21 in slots 25*a* and the spline combination 21*b* and 23*b* and floating drive element 23 with lugs 23*a* in slots 22*a* on lower portion 22. The drive shaft extension 24 is supported in the output shaft bearings (not shown) on the output shaft of the motor. The regulator ring 9, spring 11, and the separator ring 10 are unchanged and function as previously described herein. Well annulus pressure is sensed through ports 28. Drive shaft element 26 is the lower end of the output shaft of the motor, preferably a drilling motor.

Figure 11:
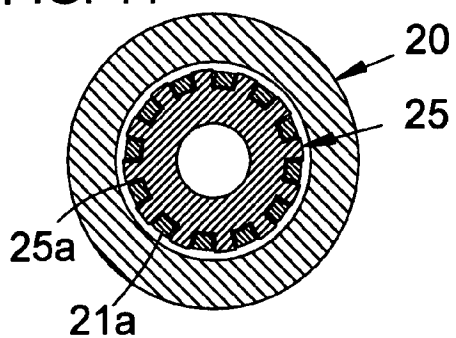
FIG. 11 is a sectional view taken along line 111 of FIG. 10.

FIG. 11 shows lugs 21*a* in slots 25*a*.

Figure 12:
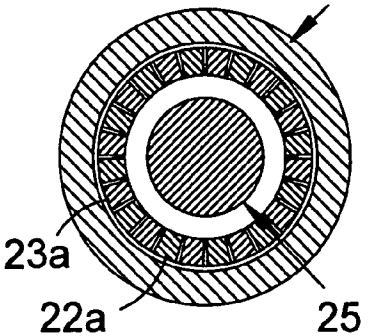
FIG. 12 is a sectional view taken along line 12 of FIG. 10.

FIG. 12 shows the lugs 23*a* in slots 22*a*. This rotational coupling is part of the deflection drive but not part of the clutch. They remain engaged. The clutch and deflection drive apparatus both utilize the lugs 21*a* and the slots 25*a*.

Figure 13:
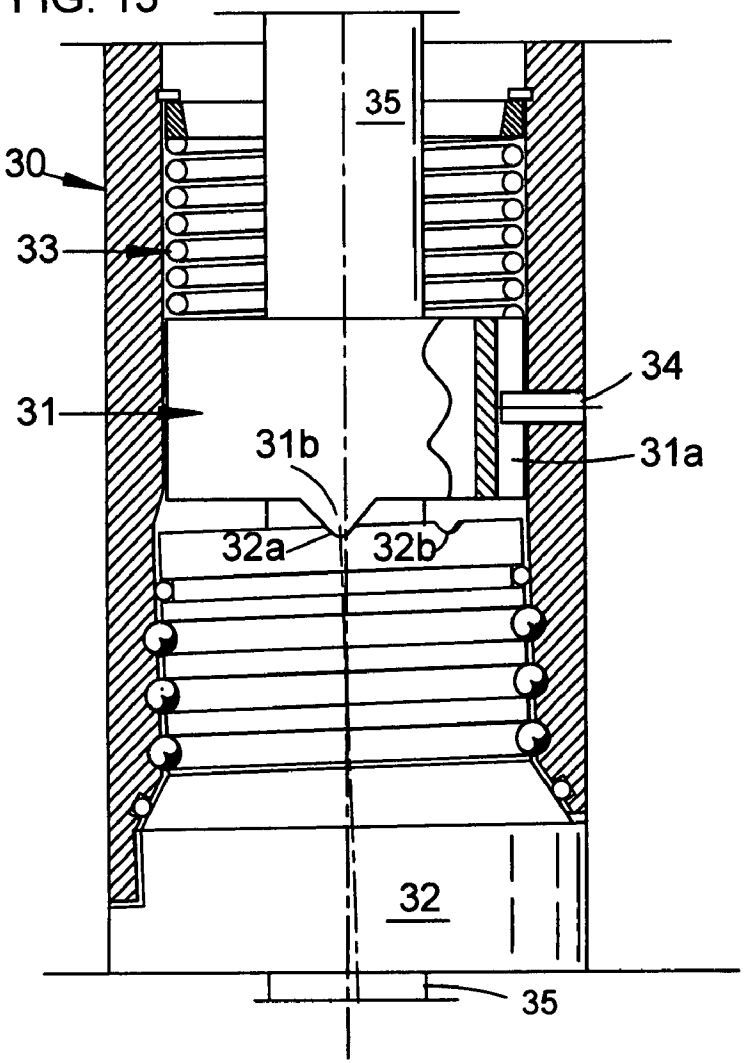
FIG. 13 is a side view, mostly cut away and rather enlarged, of an optional position retaining detent apparatus.

FIG. 13 shows a spring loaded detent arrangement to resist movement of the lower portion relative to the upper portion when the apparatus is in the straight and deflected configuration. It is more important for securing the deflected configuration and is optional for either or both configurations. The upper portion is shown as 30 and the lower portion is shown as 32. Spring 33 urges the tang carrier 31 downward pushing tang 31*b* into detent recess 32*a* or 32*b*. One recess is utilized in the straight configuration, the other recess is utilized in the deflected configuration. The tang carrier is rotationally secured in the upper portion by pin 34 in conjunction with groove 31*a*. The drive shaft is symbolically shown as 35. If used, this form of rotational security is related to the apparatus of FIGS. 3 and 4.

Figure 14:
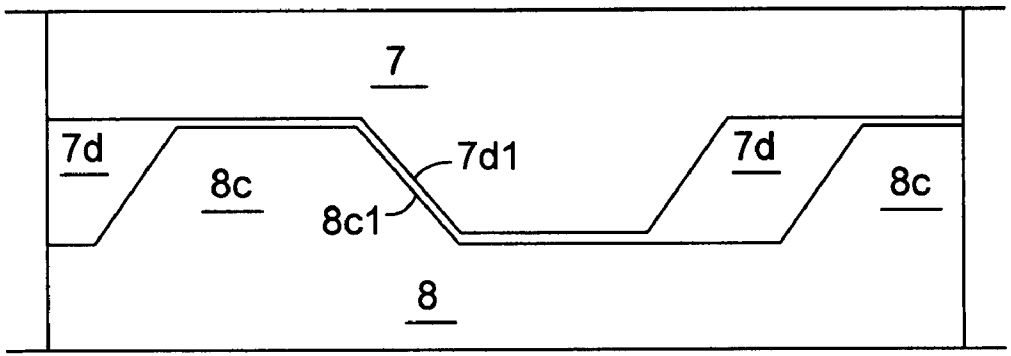
FIG. 14 is a development of a surface viewed toward a central axis.

FIG. 14 is a view of a surface development, taken in the direction of axis CLL. The view, quite enlarged, shows clutch lugs 8*c* in slots 7*d*. The clutch is torque limited by sloped engagement surfaces 7*d*1 and 8*c*1. The slope and spring load are such that a preselected motor torque causes the clutch to disengage.

From the foregoing, it will be seen that this invention is one well adapted to attain all of the ends and objects hereinabove set forth, together with other advantages which are obvious and which are inherent to the apparatus

I claim:

1. A directional drilling apparatus for use as a serial element of a drilling fluid conducting drill string, the apparatus comprising:

a) a housing comprising an upper and a lower portion, each having an independent axis, connected by an actuator bearing pack that permits rotation of said lower portion relative to said upper portion;

b) a motor situated in said upper portion, with a drive shaft extending axially into said lower portion;

c) a deflection control apparatus, in said housing, comprising said actuator bearing, with an axis of bearing rotation that is non-parallel with said axes of either said portions, and a rotation limiter to limit, between preselected limits, the rotation of said lower portion relative to said upper portion;

d) a deflection driving apparatus, in said housing, comprising a rotational linkage between said motor and said lower portion; and e) a clutch, in said housing, responsive to the characteristics of flow of drilling fluid in said housing, to selectively engage and selectively disengage said rotational linkage.

2. The apparatus of claim 1 wherein said motor is a drilling motor.

3. The apparatus of claim 1 wherein said deflection driving apparatus comprises an engageable and disengageable rotational coupling between said motor and said lower portion.

4. The apparatus of claim 1 wherein said clutch is spring loaded to move said deflection driving apparatus toward said engageable coupling position and is driven by drilling fluid flow to move toward said disengageable coupling position.

5. The apparatus of claim 1 wherein said clutch is actuated by a drilling fluid powered linear motor, responsive to a pressure difference between the interior of said housing and the exterior of said housing arranged to engage said rotational linkage in response to a preselected first drilling fluid flow rate exists in said housing and to disengage said rotational linkage when a preselected second drilling fluid flow rate, higher than said first preselected drilling flow rate, exists in said housing.

6. The apparatus of claim 5 wherein said clutch has a built-in time delay when acting to said disengage said rotational linkage.

7. The apparatus of claim 1 wherein a spring loaded detent is situated in said housing to resist movement of said lower portion from at least one of said deflected or straight configurations.

8. The apparatus of claim 1 wherein said clutch is a limited torque clutch which will disengage when exposed to a preselected driving torque.

9. A directional drilling apparatus for use as a serial element of a drilling fluid conducting drill string, the apparatus comprising:

a) a housing comprising an upper portion and a lower portion, each portion having an independent longitudinal axis, the two portions connected by a deflection actuator bearing pack arranged to allow rotation of said lower portion relative to said upper portion, said deflection actuator bearing pack having a rotational axis that has an angular relationship to, said axis of said lower portion;

b) a motor situated in said upper portion, with a drive shaft extending axially into said lower portion;

c) a deflection driving apparatus, in said housing, arranged to temporarily connect said drive shaft, rotationally, to said lower portion to rotate said lower portion relative to said upper portion;

d) a deflection control apparatus, in said housing, comprising rotational limiting abutments that allows said lower portion to rotate a preselected amount relative to said upper portion; and e) a clutch, in said housing, responsive to manipulation of said drilling fluid flow to disengage said deflection driving apparatus after a preselected time delay.

10. The apparatus of claim 9 wherein said motor is a drilling motor.

11. The apparatus of claim 9 wherein said deflection driving apparatus comprises an engageable and disengageable rotational coupling between said motor and said lower portion.

12. The apparatus of claim 9 wherein said clutch is spring loaded to move said deflection driving apparatus toward said engageable coupling position and is driven by drilling fluid flow to move toward said disengageable coupling position.

13. The apparatus of claim 9 wherein said clutch is actuated by a drilling fluid powered linear motor, responsive to a pressure difference between the interior of said housing and the exterior of said housing arranged to engage said rotational linkage in response to a preselected first drilling fluid flow rate exists in said housing and to disengage said rotational linkage when a preselected second drilling fluid flow rate, higher than said first preselected drilling flow rate, exists in said housing.

14. The apparatus of claim 13 wherein said clutch has a built-in time delay when acting to said disengage said rotational linkage.

15. The apparatus of claim 9 wherein a spring loaded detent is situated in said housing to resist movement of said lower portion from at least one of said deflected or straight configurations.

16. The apparatus of claim 9 wherein said clutch is a limited torque clutch which will conduct no more than a preselected amount of torque.

17. A method for controlling a deflection control apparatus usable as a serial element of a drilling fluid stream conducting drill string, in a well, comprising starting said stream to actuate a drilling motor in the apparatus to move said deflection driving apparatus to a deflected configuration, disconnecting the motor from said deflection driving apparatus after a preselected time delay, and drilling ahead in said deflected configuration, and rotating the drill string to use well bore drag to urge said deflection driving apparatus to a straight hole drilling configuration.

* * * * *